US005385618A

United States Patent [19]

Abita

[11] Patent Number: 5,385,618

[45] Date of Patent: Jan. 31, 1995

[54] NON-MAGNETIC ALLOY

[75] Inventor: Joseph L. Abita, Boyds, Md.

[73] Assignee: The United States of America as represented by the Secretary of the Navy, Washington, D.C.

[21] Appl. No.: 154,573

[22] Filed: Nov. 19, 1993

Related U.S. Application Data

[62] Division of Ser. No. 984,637, Dec. 2, 1992, Pat. No. 5,294,268.

[51] Int. Cl.[6] ..... C22C 9/00

[52] U.S. Cl. ..... 148/509; 420/493

[58] Field of Search ..... 148/509; 420/493

[56] References Cited

FOREIGN PATENT DOCUMENTS 0020692 5/1974 Japan ..... 420/493

OTHER PUBLICATIONS

Weiss, Wolf D. Z. Metallkde 58 (1967) 909.

Koester et al Z. Metallkde 57 (1966) 853.

Non-Ferrous Metals and Alloys (ed.) V. Sedalacek, Elsevier, N.Y. 1986, pp. 85–90.

*Primary Examiner*—Upendra Roy

*Attorney, Agent, or Firm*—John P. Tarlano

[57] ABSTRACT

A non-magnetic alloy of a volume Vcu of copper and a volume Vmn of manganese. Vmn/Vcu is made equal to −Xcu/Xmn where Xcu is the susceptibility of the copper and Xmn is the susceptibility of the manganese. Vmn/Vcu is experimentally predicted to be 1.04 percent by volume.

4 Claims, 1 Drawing Sheet

NON-MAGNETIC ALLOY

This is a division of application Ser. No. 07/984,637 filed Dec. 2, 1992, now U.S. Pat. No. 5,294,268.

BACKGROUND OF THE INVENTION

The present invention relates to a non-magnetic alloy and method for making the non-magnetic alloy.

Most materials are magnetic to some degree, i.e., exhibit ferro-, ferri-, para-, or diamagnetic behavior of a degree classified by the value of magnetic susceptibility. In diamagnetic material the magnetization (resultant magnetic moment) is opposed to the applied magnetic field, while in paramagnetic material the magnetization is in the same direction. Materials in these two groups have weak magnetism compared to ferromagnetic and ferrimagnetic materials. Furthermore, the magnetic properties of any of these types of materials can be isotropic or anisotropic.

The physical equation relating an applied magnetic field strength M to a resulting magnetization M is given by $$M=(Xm)H$$

H is a magnetic field applied to a material. M is the resultant magnetic polarization produced in the material due to the magnetic field intensity. Xm is a dimensionless proportionality called the magnetic susceptibility of the material. Xm is a positive or negative scalar constant for weak isotropic magnetic materials. Xm is a tensor constant for weak anisotropic materials. Xm is a scalar or tensor dependent on the applied field, for ferromagnetic and ferrimagnetic materials.

A non-magnetic alloy is disclosed. The non-magnetic alloy has an overall susceptiblity Xm of zero. Such an alloy assumes a magnetization of zero in the presence of a magnetic field.

There are many applications for a non-magnetic alloy. For example, magnetometers would benefit from a non-magnetic alloy. Such an alloy is particularly beneficial if the alloy has other properties that makes it suitable for fabrication as structures and gives it a low cost. Such magnetometers would be more sensitive to a magnetic field.

A binary non-magnetic alloy is disclosed. The alloy has a first material that will alloy with a second material. The susceptibilities of the two materials have opposite signs. The product and the volume amount of the first material equal the product of the susceptibility and the volume amount of the second material.

A method for making non-magnetic material is also disclosed. Magnetic materials having opposite susceptibilities are used. The magnetic materials are compatible for the formation of a homogeneous alloy. A host matrix of diamagnetic material is magnetically compensated by a paramagnetic material. Also, a host matrix of paramagnetic material could be magnetically compensated by a diamagnetic material. A first volume of a host matrix of weakly diamagnetic material is magnetically compensated by a smaller second volume of a of stronger paramagnetic material. A dilute distribution is formed in the host matrix. Also, a first volume of a host matrix of weakly paramagnetic material could be magnetically compensated by a smaller second volume of stronger diamagnetic material. Again a dilute distribution could be formed in the host matrix.

In the method, volume amounts of diamagnetic material are taken from a reservoir of diamagnetic material. Various volume amounts of a paramagnetic material that will alloy with the diamagnetic material, are added to the volume amounts of diamagnetic material. Alloy samples having diamagnetic material and paramagnetic material therein are thereby produced. The magnetization of each alloy sample is measured. The magnetizations of the alloy samples versus their percentages by volume of paramagnetic material to diamagnetic material are plotted. A percentage by volume of paramagnetic material to diamagnetic material that will produce an alloy sample that has a magnetization of zero is determined. A volume amount of paramagnetic material is mixed into a production volume amount of said diamagnetic material. A mixture is produced that has the same percentage by volume of paramagnetic material to diamagnetic material as the determined percentage. The components of the mixture are alloyed together. The resultant alloy is a non-magnetic alloy.

In the method, volume amounts of a paramagnetic material may be taken from a reservoir of paramagnetic material. Various volume amounts of a diamagnetic material that will alloy with the paramagnetic material, may be added to the volume amounts of paramagnetic material. Alloy samples having paramagnetic material and diamagnetic material therein may thereby be produced. The magnetization of each alloy sample may be measured. The magnetizations of the alloy samples versus their percentages by volume of diamagnetic material to paramagnetic material may be plotted. A percentage by volume of diamagnetic material to paramagnetic material that will produce an alloy sample that has a magnetization of zero may be determined. A volume amount of diamagnetic material may be mixed into a production volume amount of said original paramagnetic material. A mixture may be produced that has the same percentage by volume of diamagnetic material to paramagnetic material as the determined percentage. The components of the mixture may be alloyed together. The resultant alloy is a non-magnetic alloy.

SUMMARY OF THE INVENTION

A non-magnetic metal alloy comprising a first volume amount of a first material that has a first value of susceptibility, and a second volume amount of a second material that has a second value of susceptibility, the sign of the second value being opposite to the sign of the first value, the product of the value of the first volume amount times the first value of susceptibility being equal to the negative product of the value of the second volume amount times the second value of susceptibility.

DESCRIPTION OF THE PREFERRED EMBODIMENT

Figure 1:
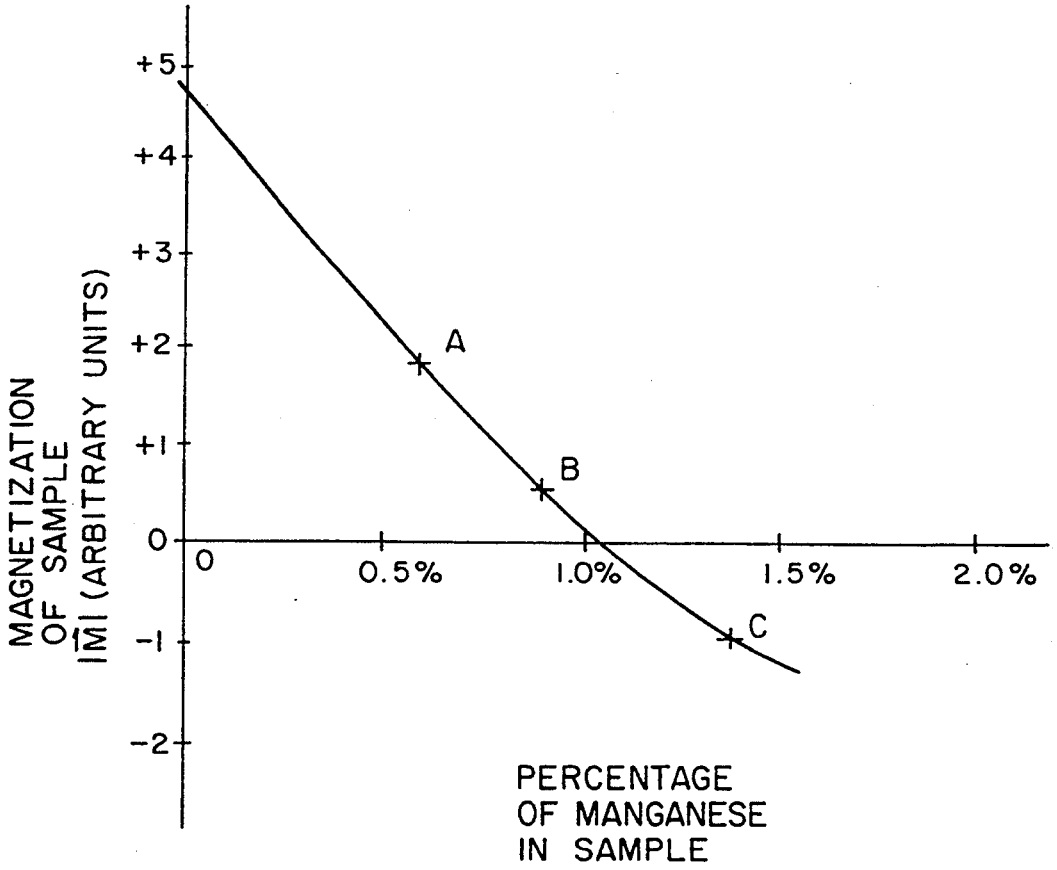
FIG. 1 is a plot of the magnetizations of copper base samples versus their percentage by volume of manganese material to copper base material.

A non-magnetic alloy of pure copper plus pure manganese can be made. A volume amount Vcu of pure copper is taken. A volume amount Vmn of pure manganese is mixed with the volume amount a pure copper. The mixture is melted and cooled to alloy the copper and manganese together. The alloy has a resultant magnetization Mcumn (per unit volume) given by Mcumn=[(XcuVcu+XmnVmn)/Vcumn] H. Mcumn=0 since (Vmn)(Xmn) is made to be equal to −(Xcu)(Vcu). Pure copper has a susceptibility, Xcu, of value −0.086×10−6 cgs. Pure manganese has a susceptibility, Xmn, of value +9.9×10−6 cgs.

This method assumes that the pure manganese is uniformly distributed throughout the pure copper host, that atomic magnetic coupling effects are not long range relative to the distance between Mn atoms in the Cu host, and that manganese and copper atoms do not couple for enhanced magnetic effects.

A simple calculation, using the next equation, gives the volume amount Vmn of pure manganese that is used to "neutralize" a volume amount Vcu of pure copper. The calculation is (Vmn)/(Vcu)=−(Xcu)/(Xmn). Substituting in the values given above for Xcu and Xmn, the ratio of Vmn to Vcu is found in order to give zero magnetization Mcumn. For Mcumn=0, (Vmn)/(Vcu)=−(−0.086×10−6)/(+9.9×10−6)=-0.00869. Therefore, 0.869% by volume of pure manganese to pure copper (at room temperature) should theoretically produce a non-magnetic alloy. The value of 0.869 percent by volume of pure manganese to pure copper will make pure copper non-magnetic.

For unpure copper material, a modified method was used. Three volume amounts were taken from an unpure diamagnetic copper base material. The diamagnetic copper base material was basically copper. The copper base material may have had diamagnetic and/or paramagnetic and/or ferromagnetic impurities therein, as well as copper. The susceptibility of the copper base material was diamagnetic. The three copper base volume amounts had approximately equal volumes.

The three solid copper based volume amounts were placed in three inert crucibles. Three different volume amounts of solid paramagnetic manganese material are added to the three solid copper base volume amounts. The crucibles were covered. The crucibles are heated to sufficient temperatures in three vacuum chambers, in order to melt the material in the crucibles. Alloy samples are formed in the three crucibles.

The volumes of manganese material are selected in order to form copper base alloy samples A, B and C. Samples A, B and C had 0.57, 0,869 and 1.4 percent by volume of manganese material to the copper base material.

The same magnetic field strength M was applied for the same period of time to each of the samples in order to magnetize each of them.

The magnetizations M of the alloy samples were then measured. Sample A had a magnetization of plus 1.9 arbitrary units of magnetization. Sample B had a magnetization of plus 0.5 units of magnetization. Sample C had a magnetization of minus 0.85 units of magnetization. These measurements were performed by measuring the magnetic induction produced by each of the magnetized samples.

A plot, such as shown in FIG. 1, was made of the measured magnetizations of the copper base samples versus their percentages by volume of manganese material to copper base material. The percentage of manganese by volume that would make the copper base material non-magnetic, was identified from the plot as shown in FIG. 1. The identified crossover percentage from the plot, as shown in FIG. 1, was 1.04 percent by volume of manganese material to copper base material. The magnetization of a copper base sample having this percentage of the manganese material to copper base material would be zero.

This identified crossover percentage from FIG. 1 is used in order to mix a large volume of of the solid copper based material with solid manganese material. The mixture is heated to a sufficient temperature to form an alloy. A copper based alloy mass having the identified crossover percentage of 1.04 percent by volume of manganese material to copper base material, is produced. This produced copper based alloy is essentially a non-magnetic copper based alloy. The alloy can be used to fabricate various non-magnetic articles of manufacture.

It is believed that the copper base material that was used to make the copper base samples was not pure copper. The impurities could have been diamagnetic, causing the experimental crossover percentage to be 1.04 percent rather than 0.869 percent.

Some of the problems addressed and solved in part were:

(1) different vapor pressures of the constituent elements, (2) different melting points of the constituent elements, (3) environmental reactivity of Mn and Cu, (4) achieving homogeneity of the constituent elements, and (5) exact magnetic "neutralization" i.e., Mcumn equal to exactly zero.

Problems (1), (2), and (3) were successfully managed. Laboratory grade copper and manganese were vacuum alloying in a closed inert crucible. Vacuum alloyed samples were thus produced. Problem and remains as a challenge. Problem (5) is essentially solved by the present invention.

Core cylinders were fabricated from the vacuum alloyed copper base samples. The magnetic properties of the core cylinders were measured at the National Bureau of Standards. The results are qualitatively illustrated in FIG. 1, and demonstrate that there is a magnetic crossover for the alloy system. The alloy system is copper and manganese.

The crossover point in the plot of FIG. 1 occurred at a higher than expected value. This could also be accounted for by loss of manganese from the original (pre-melt) amount. Also, a relatively large slope of the curve in the vicinity of the neutral point suggests the it could be difficult to affect M=0 to say 1 part in 10+8 or 10+9; however, trim methods could be used. Therefore, using the above described process and elements, the invention provides non-magnetic alloy material for use in magnetometers, satellite proof masses, and magnetic measurement and detection systems.

While the present invention has been disclosed in connection with the preferred embodiment thereof, it should be understood that there may be other embodiments which fall within the spirit and scope of the invention as defined by the following claims.

What is claimed is:

1. A non-magnetic alloy, comprising:

(a) a first volume amount of a first copper material that has a first value of susceptibility; and (b) a second volume amount of a second manganese material that has a second value of susceptibility, the sign of the second value of susceptibility being opposite to the sign of the first value of susceptibility, the product of the value of the first volume amount times the first value of susceptibility being equal to the negative product of the value of the second volume amount times the second value of susceptibility, a resultant non-magnetic alloy having a percent by volume of manganese that is higher than 0.57 percent by volume.

2. A non-magnetic alloy, comprising:

(a) a first volume amount of a diamagnetic copper material that has a first value of susceptibility; and (b) a second volume amount of a paramagnetic manganese material that has a second value of susceptibility, the product of the value of the first volume amount times the first value of susceptibility being equal to the negative product of the value of the second volume amount times the second value of susceptibility, a resultant non-magnetic alloy having a percent by volume of manganese that is found in a ranqe between 0.57 percent and 1.4 percent by volume.

3. A non-magnetic alloy, comprising:

(a) a first volume amount of a paramagnetic manganese material that has a first value of susceptibility; and (b) a second volume amount of a diamagnetic copper material that has a second value of susceptibility, the product of the value of the first volume amount times the first value of susceptibility being equal to the negative product of the value of the second volume amount times the second value of susceptibility., a resultant nonmagnetic alloy having a percent by volume of manganese that is found in a ranqe between 0.869 percent by volume and 1.4 percent by volume.

4. A non-magnetic alloy, comprising:

(a) a first volume amount of a diamagnetic copper base material that has a first value of susceptibility; and (b) a second volume amount of a paramagnetic manganese material that has a second value of susceptibility, the product of the value of the first volume amount times the first value of susceptibility being equal to the negative product of the value of the second volume amount times the second value of susceptibility, a resultant non-magnetic alloy having a percent by volume of manganese that is near 1.04 percent by volume.

* * * * *